US010436010B2

(12) United States Patent
Wesley et al.

(10) Patent No.: US 10,436,010 B2
(45) Date of Patent: Oct. 8, 2019

(54) STUCK PIPE DETECTION

(71) Applicant: Landmark Graphics Corporation, Houston, TX (US)

(72) Inventors: Avinash Wesley, Houston, TX (US); Peter C. Yu, Houston, TX (US)

(73) Assignee: Landmark Graphics Corporation, Houston, TX (US)

( * ) Notice: Subject to any disclaimer, the term of this patent is extended or adjusted under 35 U.S.C. 154(b) by 788 days.

(21) Appl. No.: 14/889,941

(22) PCT Filed: Nov. 5, 2014

(86) PCT No.: PCT/US2014/063988
§ 371 (c)(1),
(2) Date: Nov. 9, 2015

(87) PCT Pub. No.: WO2016/072978
PCT Pub. Date: May 12, 2016

(65) Prior Publication Data
US 2016/0290121 A1 Oct. 6, 2016

(51) Int. Cl.
*E21B 47/00* (2012.01)
*E21B 44/00* (2006.01)
*E21B 47/09* (2012.01)

(52) U.S. Cl.
CPC ..... *E21B 47/00* (2013.01); *E21B 44/00* (2013.01); *E21B 47/0006* (2013.01); *E21B 47/09* (2013.01)

(58) Field of Classification Search
CPC ..... E21B 47/00; E21B 44/00; E21B 47/0006; E21B 47/09
USPC ..... 702/9
See application file for complete search history.

(56) References Cited

U.S. PATENT DOCUMENTS

| | | | | |
|---|---|---|---|---|
| 4,545,242 | A | 10/1985 | Chan | |
| 4,886,129 | A * | 12/1989 | Bourdon | E21B 12/02 175/40 |
| 6,912,904 | B2 | 7/2005 | Storm et al. | |
| 9,374,660 | B1 * | 6/2016 | Tilles | H04L 67/02 |
| 2002/0198661 | A1 | 12/2002 | Strickland | |
| 2005/0240351 | A1 | 10/2005 | Gray | |
| 2014/0110167 | A1 | 4/2014 | Goebel et al. | |
| 2014/0260592 | A1 | 9/2014 | Mason et al. | |
| 2017/0241252 | A1 * | 8/2017 | Hernandez | E21B 44/00 |
| 2017/0306726 | A1 * | 10/2017 | Alzahrani | E21B 44/00 |

FOREIGN PATENT DOCUMENTS

| | | | |
|---|---|---|---|
| EP | 0354716 | A1 | 2/1990 |
| WO | 2014160625 | A1 | 10/2014 |

OTHER PUBLICATIONS

Baker Hughes, Drilling EngineeringWorkbook, Dec. 1995.*
(Continued)

*Primary Examiner* — Michael P Nghiem
*Assistant Examiner* — Dacthang P Ngo
(74) *Attorney, Agent, or Firm* — Howard L. Speight, PLLC

(57) ABSTRACT

Tight spots in movements of a drill string in an oil well are identified by comparing a large interval hookload moving average to a short interval hookload moving average, comparing a large interval bit depth moving average to a short interval bit depth moving average, and DBSCANing the tight spots to identify a fully-stuck event.

13 Claims, 5 Drawing Sheets

(56) References Cited

OTHER PUBLICATIONS

Maghsoudi, Identification and characterization of growing large-scale en-echelon fracture in a salt mine, Nov. 2013.*
International Searching Authority, Patent Cooperation Treaty, International Application No. PCT/US2014/063988, which is a parent PCT to the instant application, Jul. 30, 2015.
English translation of National Institute of Industrial Property, Patent Department, Notification of irregularities, Patent Application No. 15-58995, which is an FR counterpart to the instant application, Jan. 28, 2016.
National Institute of Industrial Property, Patent Department, Notification of irregularities, Patent Application No. 15-58995, which is an FR counterpart to the instant application, Jan. 28, 2016.
English Translation of Instieut National De La Propriete Industrielle, Opinion Ecrite Sur La Brevetabilite De L'Invention, Written Opinion, Republique Francaise.
English Translation of Institut National De La Propriete Industrielle, Preliminary French Search Report, Republique Franqaise.
Instieut National De La Propriete Industrielle, Opinion Ecrite Sur La Brevetabilite De L'Invention, Written Opinion, Republique Francaise.
Institut National De La Propriete Industrielle, Preliminary French Search Report, Republique Franqaise.

* cited by examiner

STUCK PIPE DETECTION

BACKGROUND

Drilling a borehole to form a well often involves the use of drill pipe with a bit attached. Drill pipe may become stuck in the borehole for a variety of reasons. Continuing to operate drilling equipment when the drill pipe is stuck may damage the drill pipe or the drilling equipment. Detecting that a drill pipe is stuck in a borehole is a challenge.

DETAILED DESCRIPTION

While this disclosure describes a land-based drilling system, it will be understood that the equipment and techniques described herein are applicable in sea-based systems, multilateral wells, all types of drilling systems, all types of rigs, measurement while drilling ("MWD")/logging while drilling ("LWD") environments, wired drillpipe environments, coiled tubing (wired and unwired) environments, wireline environments, and similar environments.

Figure 1:
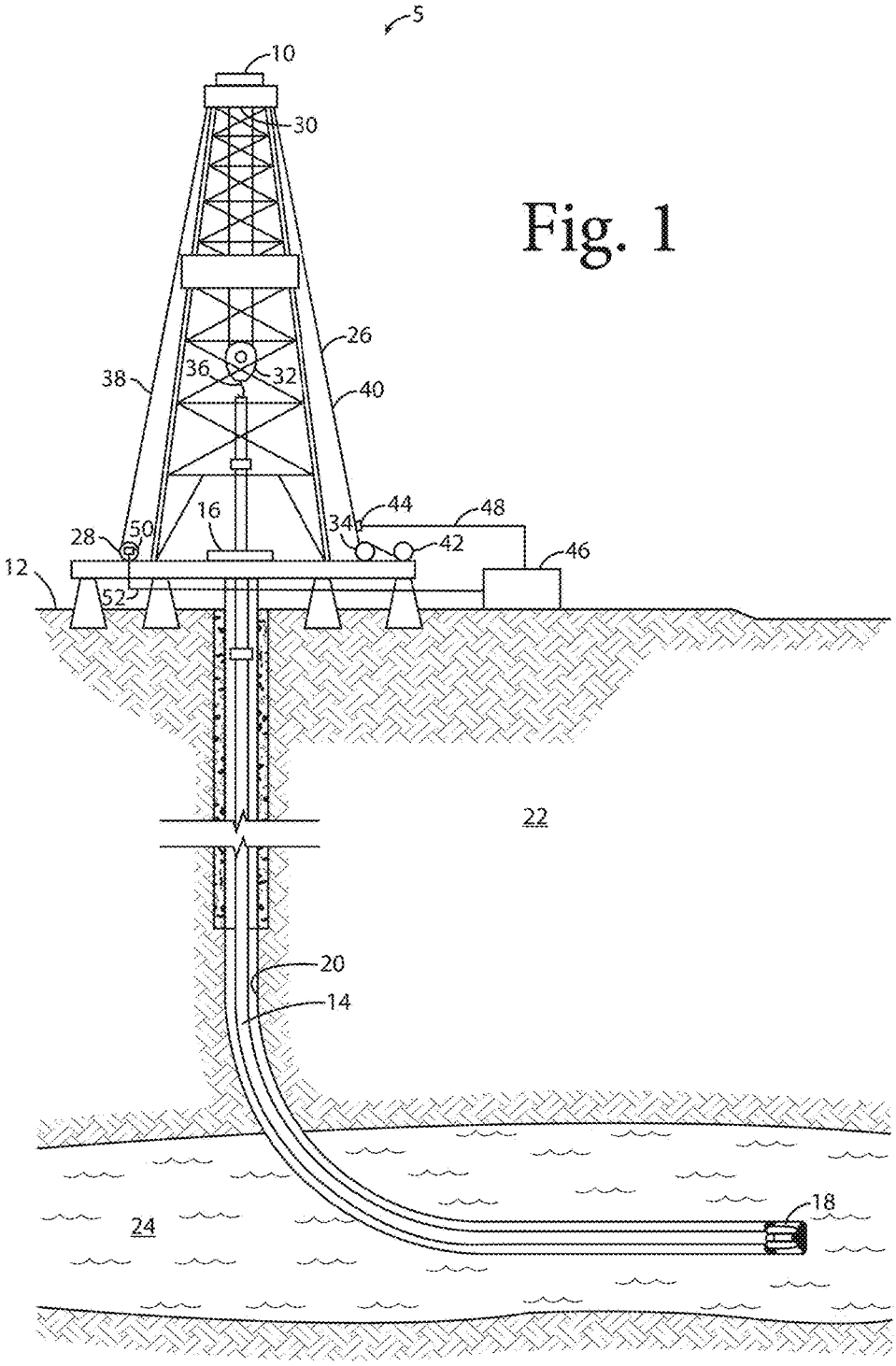
FIG. 1 is a schematic diagram of a land-based drilling system.

One embodiment of a system for drilling operations (or "drilling system") 5, illustrated in FIG. 1, includes a drilling rig 10 at a surface 12, supporting a drill string 14. In one embodiment, the drill string 14 is an assembly of drill pipe sections which are connected end-to-end through a work platform 16. In alternative embodiments, the drill string comprises coiled tubing rather than individual drill pipes. In one embodiment, a drill bit 18 is coupled to the lower end of the drill string 14, and through drilling operations the bit 18 creates a borehole 20 through earth formations 22 and 24.

In one or more embodiments, the drilling system 5 includes a drill line 26 to raise and lower the drill string 14 in the borehole 20. In one or more embodiments, the drill line 26 is spooled on a winch or draw works 28. In one or more embodiments, the drill line 26 passes from the winch or draw works 28 to a crown block 30. In one or more embodiments, the drill line passes from the crown block 30 to a traveling block 32 back to the crown block 30 and to an anchor 34. In one or more embodiments, a hook 36 couples the traveling block 32 to the drillstring 14. In one or more embodiments, the crown block 30 and the traveling block 32 act as a block-and-tackle device to provide mechanical advantage in raising and lowering the drill string 14. In one or more embodiments, the drill line 26 includes a fast line 38 that extends from the draw works 28 to the crown block 30 and a deadline 40 that extends from the crown block 30 to the anchor 34. In one or more embodiments, a supply spool 42 stores additional drill line 26 that can be used when the drill line 26 has been in use for some time and is considered worn.

In one or more embodiments, a hookload sensor 44 provides signals representative of the load imposed by the drill string 14 on the hook 36. In one or more embodiments, the hookload sensor 44 is coupled to the deadline 40 to measure the tension in the drill line 26. In one embodiment, signals from the hookload sensor 44 are coupled to a processor 46 by a cable 48. The processor 46 processes the signals from the hookload sensor 44 to determine "hookload," which is the weight of the drill string 14 suspended from the hook 36.

In one or more embodiments, a bit depth sensor 50 provides signals representative of the depth of the bit 18 in the borehole 20. In one or more embodiments, the bit depth sensor is an optical sensor that measures the rotation of the winch or draw works 28. In one embodiment, signals from the bit depth sensor 50 are coupled to the processor 46 by a cable 52. The processor 46 processes the signals from the bit depth sensor 44 to determine "bit depth," which is the distance along the borehole 20 from the surface 12 to the bit 18.

The drill string 14 may become stuck in the borehole 20 for a variety of reasons, including a collapse of the borehole 20, differential sticking in which the pressure exerted by drilling fluids overcomes formation pressures causing the drill string 14 to stick to the wall of the borehole 20, swelling of the borehole 20, etc. Once the drill string 14 is stuck, pulling on the drill string 14 with a pressure beyond a safe limit may damage the drill string 14 or other equipment in the drilling system 5.

Figure 2:
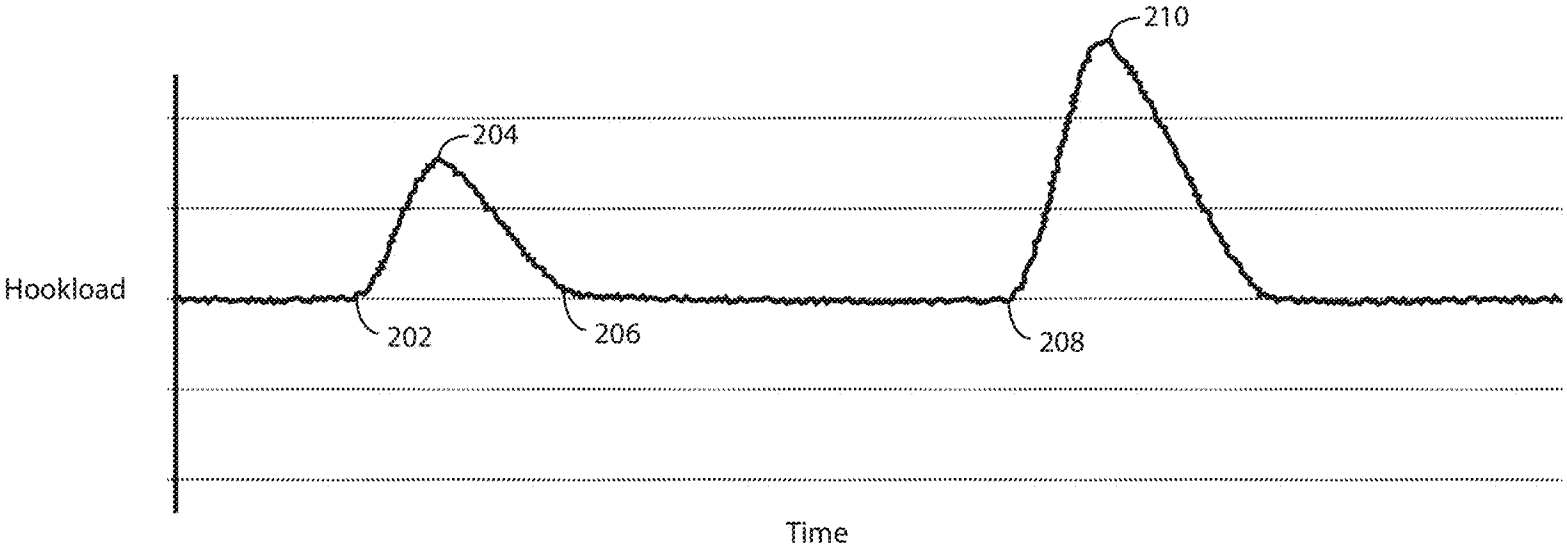
FIG. 2 is a graph showing hookload over time in a stuck pipe situation.

This is illustrated in FIG. 2, which shows hookload on the vertical axis and time on the horizontal axis. As can be seen, the hookload is relatively steady, indicating a normal tripping out operation, until point 202 where it begins to rise dramatically. At point 204, a person responsible for controlling the amount of pull on the drill line 26 and therefore on the drill string 14 (i.e., a "driller") realizes that the hookload has increased and reduces the amount of pull. The hookload then falls back to a normal level at about point 206. The driller spends the time between points 206 and 208 deciding what to do next, perhaps by reviewing data and talking to other drillers. Then at point 208, the driller decides to exert a greater pull than that previously applied and begins to increase the pull until point 210, where damage is done to the drill string 14 or to other parts of the drilling system 5.

In one or more embodiments, tight spots in movements of the drill string 14 in the borehole 20 are identified by comparing a large interval hookload moving average to a short interval hookload moving average and comparing a large interval bit depth moving average to a short interval bit depth moving average. In one or more embodiments, the tight spots are then DBSCANNED (discussed below) to identify a fully-stuck event.

In one or more embodiments, the processor 46 receives periodic signals from the hookload sensor 44. In one or more embodiments, each time the processor 46 receives a signal from the hookload sensor 44, it computes moving averages of these signals by averaging the values received from the sensors over periods of time. In one or more embodiments, the processor computes the moving averages for every Pth periodic signal received from the hookload sensor 44, where $P \geq 2$.

In one or more embodiments, the processor 46 computes a large interval hookload moving average by computing an average of the signals received from the hookload sensor 44 over a large interval of time:

$$\text{moving_avg_L_HKLD} = \frac{\sum_{t_c-t_o-L_{HKLD}}^{t_c-t_o}(\text{signal from hookload sensor 44})}{N_{HKLD}} \quad (1)$$

where:

$t_c$=current time, $t_o$=offset, $L_{HKLD}$=time length of hookload large interval, $N_{HKLD}$=the number of samples taken during the hookload large interval.

For example, if $t_o$ is zero and $L_{HKLD}$ is 4 minutes (or 240 seconds), the processor 46 will add the signals from the hookload sensor 44 for the preceding 4 minutes beginning at the current time and divide by $N_{HKLD}$. If $t_o$ is 30 seconds and $L_{HKLD}$ is 4 minutes, the processor 46 will add the signals from the hookload sensor 44 for the preceding 4 minutes beginning 30 seconds before the current time and divide by $N_{HKLD}$.

In one or more embodiments, the processor 46 computes a small interval hookload moving average by computing an average of the signals received from the hookload sensor 44 over a small interval of time:

$$\text{moving_avg_S_HKLD} = \frac{\sum_{t_c-t_o-S_{HKLD}}^{t_c-t_o}(\text{signal from hookload sensor 44})}{M_{HKLD}} \quad (2)$$

where:

$t_c$=current time, $t_o$=offset, $S_{HKLD}$=time length of hookload small interval, $M_{HKLD}$=the number of samples taken during the hookload small interval.

For example, if $t_o$ is zero and $S_{HKLD}$ is 15 seconds, the processor 46 will add the signals from the hookload sensor 44 for the preceding 15 seconds beginning at the current time and divide by $M_{HKLD}$. If $t_o$ is 30 seconds and $S_{HKLD}$ is 15 seconds, the processor 46 will add the signals from the hookload sensor 44 for the preceding 15 seconds beginning 30 seconds before the current time and divide by $M_{HKLD}$.

In one or more embodiments, $L_{HKLD}>S_{HKLD}$. In one or more embodiment, $L_{HKLD}>>$(i.e., is much greater than) $S_{HKLD}$. In one or more embodiments, "much greater than" means at least 50 times more. In one or more embodiments, "much greater than" means at least 16 times more. In one or more embodiments, "much greater than" means at least 8 times more.

In one or more embodiments, the processor 46 receives periodic signals from the bit depth sensor 50. In one or more embodiments, each time the processor 46 receives a signal from the bit depth sensor 50, it computes moving averages of these signals by averaging the values received from the sensors over periods of time. In one or more embodiments, the processor computes the moving averages for every Qth periodic signal received from the bit depth sensor 50, where $Q \geq 2$.

In one or more embodiments, the processor 46 computes a large interval bit depth (or block position or BLK_POS) moving average by computing an average of the signals received from the bit depth sensor 50 over a large interval of time:

$$\text{moving_avg_L_BLK_POS} = \frac{\sum_{t_c-t_o-L_{BLK,POS}}^{t_c-t_o}(\text{signal from bit depth sensor 50})}{N_{BLK_POS}} \quad (3)$$

where:

$t_c$=current time, $t_o$=offset, $L_{BLK_POS}$=time length of bit depth large interval, $N_{BLK_POS}$=number of samples taken during the bit depth large interval.

For example, if $t_o$ is zero and $L_{BLK_POS}$ is 4 minutes (or 240 seconds), the processor 46 will add the signals from the bit depth sensor 50 for the preceding 4 minutes beginning at the current time and divide by $N_{BLK_POS}$. If $t_o$ is 30 seconds and $L_{BLK_POS}$ is 4 minutes, the processor 46 will add the signals from the bit depth sensor 50 for the preceding 4 minutes beginning 30 seconds before the current time and divide by $N_{BLK_POS}$.

In one or more embodiments, the processor 46 computes a small interval bit depth (or block position or BLK_POS) moving average by computing an average of the signals received from the bit depth sensor 50 over a small interval of time:

$$\text{moving_avg_S_BLK_POS} = \frac{\sum_{t_c-t_o-S_{BLK,POS}}^{t_c-t_o}(\text{signal from hookload sensor 44})}{M_{BLK_POS}} \quad (4)$$

where:

$t_c$=current time, $t_o$=offset, $S_{BLK_POS}$=time length of bit depth small interval, $M_{BLK_POS}$=number of samples taken during the bit depth small interval.

For example, if $t_o$ is zero and $S_{BLK_POS}$ is 15 seconds, the processor 46 will add the signals from the bit depth sensor 50 for the preceding 15 seconds beginning at the current time and divide by $M_{BLK_POS}$. If $t_o$ is 30 seconds and $S_{BLK_POS}$ is 15 seconds, the processor 46 will add the signals from the bit depth sensor 50 for the preceding 15 seconds beginning 30 seconds before the current time and divide by $M_{BLK_POS}$.

In one or more embodiments, the $L_{BLK_POS}>S_{BLK_POS}$. In one or more embodiment, $L_{BLK_POS}>>$(i.e., is much greater than) $S_{BLK_POS}$. In one or more embodiments, "much greater than" means at least 50 times more. In one or more embodiments, "much greater than" means at least 16 times more. In one or more embodiments, "much greater than" means at least 8 times more.

In one or more embodiments, $L_{HKLD}=L_{BLK_POS}$. In one or more embodiments, $L_{HKLD}\neq L_{BLK_POS}$.

In one or more embodiments, $S_{HKLD}=S_{BLK_POS}$. In one or more embodiments, $S_{HKLD}\neq S_{BLK_POS}$.

In one or more embodiments, $N_{HKLD}=N_{BLK_POS}$. In one or more embodiments, $N_{HKLD}\neq N_{BLK_POS}$.

In one or more embodiments, $M_{HKLD}=M_{BLK_POS}$. In one or more embodiments, $M_{HKLD}\neq M_{BLK_POS}$.

Figure 3:
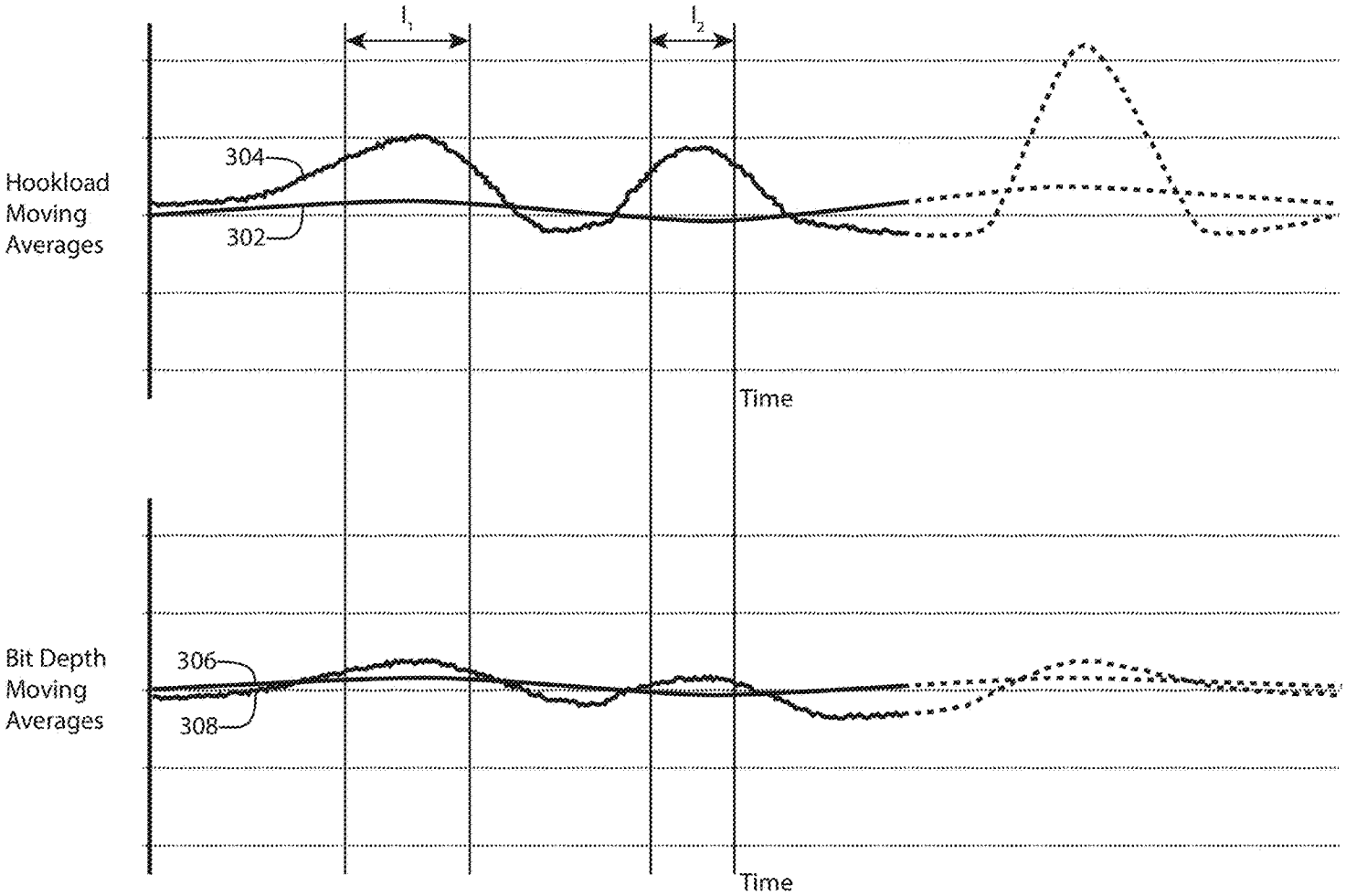
FIG. 3 is two graphs showing hookload moving averages and bit depth moving averages over time.

FIG. 3 shows examples of the moving averages. FIG. 3 shows two sets of axes. The first set of axes at the top of the figure is for hookload moving averages. In one or more embodiments, the units of the horizontal axis for the first set of axes is time. In one or more embodiments, the vertical axis for the first set of axes is a logarithmic scale having units of thousands of pounds of force ("kips"). The second set of axes at the bottom of the figure is for bit depth moving averages. In one or more embodiments, the units for the horizontal axis for the second set of axes is time. In one or more embodiments, the horizontal axis for the second set of axes is aligned with the horizontal axis for the first set of axes. In one or more embodiments, the vertical axis for the first set of axes has units of feet.

In one or more embodiments, the first set of axes in FIG. 3 shows a large interval hookload moving average 302 and a small interval hookload moving average 304. In one or more embodiments, the second set of axes in FIG. 3 shows a large interval bit depth moving average 306 and a short interval bit depth moving average 308. Note that in both cases, in one or more embodiments, the long interval moving average (i.e., 302 and 306) is smoother than the short interval moving average (i.e., 304 and 308). This is because, in one or more embodiments, the long interval moving averages capture the broader trends, filtering out some of the instantaneous trends that are evident in the short interval moving averages. In one or more embodiments, the technique described herein takes advantage of that differences between the long interval moving averages and the short interval moving averages to identify "tight spot" events. In one or more embodiments, a tight spot event occurs when the absolute value of the difference between the large interval hookload moving average 302 and the short interval hookload moving average 304, ΔHKLD, is greater than a hookload threshold, $TH_{HKLD}$, and the absolute value of the difference between the large interval bit depth moving average 306 and the short interval bit depth moving average 308, ΔBLK_POS, is less than a bit depth threshold, $TH_{BLK}$:

$$\Delta HKLD > TH_{HKLD} \text{ AND } \Delta BLK_POS < TH_{BLK} \quad (5)$$

where:

$$\Delta HKLD = |moving_avg_L_HKLD - moving_avg_S_HKLD| \quad (6)$$

$$\Delta BLK_POS = |moving_avg_L_BLK_POS - moving_avg_S_BLK_POS| \quad (7)$$

Such a determination indicates that hookload is increasing while the bit is not moving as much as expected, which is a symptom of a tight spot.

In the example shown in FIG. 3, this condition is met over intervals $I_1$ and $I_2$. When a reading from the hookload sensor 44 and/or the bit depth sensor 50 is received and equation (5) is satisfied, the processor retrieves the bit depth and stores it as part of a tight spot record.

In one or more embodiments, the processor analyzes the stored tight spot records to determine if they are clustered in depth. A cluster of tight spot records at a particular depth indicates that the drill string 14 is stuck at that depth.

In one or more embodiments, the processor runs a DBSCAN of the depths in stored tight spot records. "DBSCAN" is an acronym for Density-Based Spatial Clustering of Applications with Noise. In one or more embodiments, the DBSCAN finds clusters of tight spot records within a depth range (ε) of a fully-stuck depth associated with one of the tight spot records. In one or more embodiments, if the number of such points is greater than a threshold M, then the processor 46 displays a fully-stuck event on a display. In one or more embodiments, the driller can then halt operations and avoid the event shown in dashed lines in FIG. 3 that might result in damage to the drill string 14 or other drilling system 5 equipment. In one or more embodiments, ε<=10 feet and M>=30 points. In one or more embodiments, ε<=50 feet and M>=60 points. In one or more embodiments, ε<=100 feet and M>=300 points.

Figure 4:
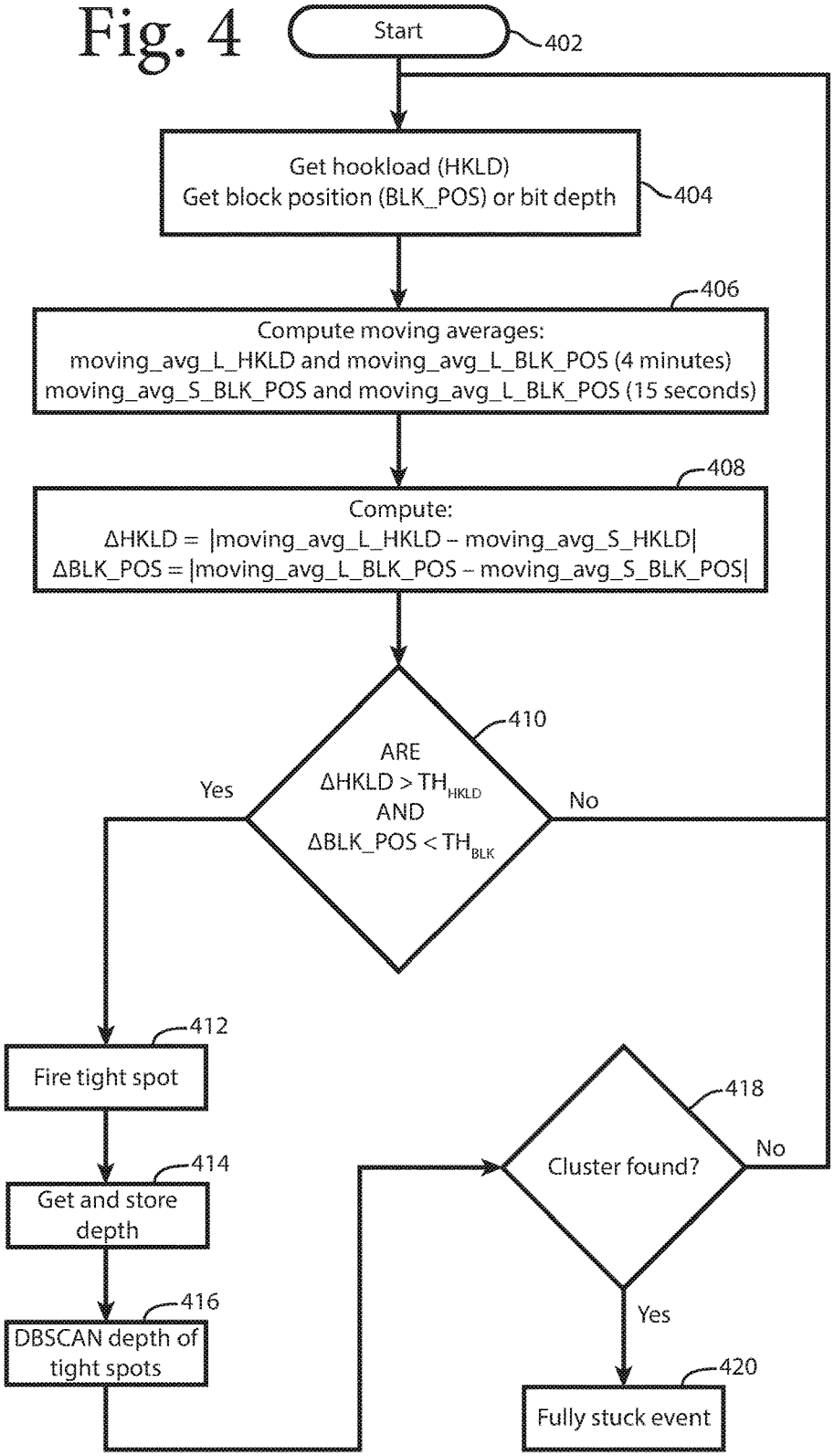
FIG. 4 is a flow chart showing a technique for detecting a stuck pipe.

In one or more embodiments, as shown in FIG. 4, the stuck pipe detection process begins (block 402) and enters a loop. In one or more embodiments, the processor 46 retrieves hookload (HLKD) from the hookload sensor 44 and block position (BLK_POS) or bit depth from the bit depth sensor 50 (block 404). In one or more embodiments, the processor 46 computes the moving averages using equations (1) through (4) (block 406). In one or more embodiments, the processor 46 computes ΔHKLD and ΔBLK_POS using equations (6) and (7) (block 408). In one or more embodiments, the processor then applies the condition of equation (5) (block 410).

In one or more embodiments, if the condition of equation (5) is satisfied ("Yes" branch from block 410), the processor "fires" a tight spot (block 412), retrieves and stores the bit depth in a "tight spot" record in a file or database accessible to DBSCAN (block 414). The processor then DBSCANs the tight spot depths (block 416). In one or more embodiments, if a cluster is found ("Yes" branch from block 418), the processor 46 declares a fully stuck event and provides an alarm on a display available to the driller. If a cluster is not found ("No" branch from block 418), the processor returns to the beginning of the loop (block 404).

Similarly, if the condition of equation (5) is not satisfied ("No" branch from block 410), the processor returns to the beginning of the loop (block 404).

Once a fully stuck event has been declared, the processor 46 monitors the bit depth sensor 50 for an indication that the drill string 14 has been freed and has moved out of the bit depth ranges of any tight spot clusters. The processor 46 then clears the fully stuck event and removes the alarm from the display.

Figure 5:
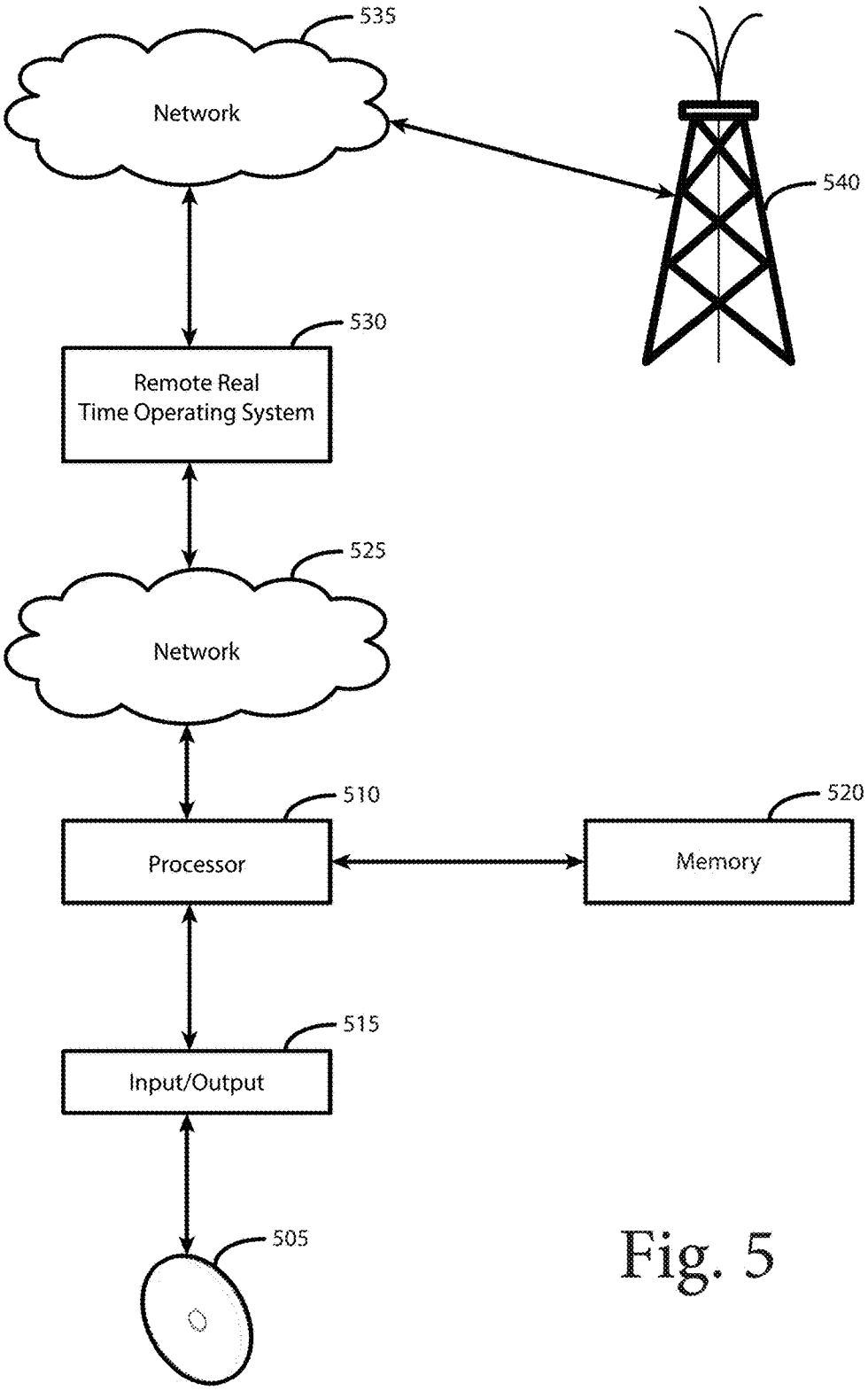
FIG. 5 is a block diagram of an environment.

In one embodiment, shown in FIG. 5, the process described above is performed by software in the form of a computer program on a non-transitory computer readable media 505, such as a CD, a DVD, a USB drive, a portable hard drive or other portable memory. In one embodiment, a processor 510, which may be the same as or included in the processor 46, reads the computer program from the computer readable media 505 through an input/output device 515 and stores it in a memory 520 where it is prepared for execution through compiling and linking, if necessary, and then executed. In one embodiment, the system accepts inputs through an input/output device 515, such as a keyboard or keypad, mouse, touchpad, touch screen, etc., and provides outputs through an input/output device 515, such as a monitor or printer. In one embodiment, the system stores the results of calculations in memory 520 or modifies such calculations that already exist in memory 520.

In one embodiment, the results of calculations that reside in memory 520 are made available through a network 525 to a remote real time operating center 530. In one embodiment, the remote real time operating center 530 makes the results of calculations available through a network 535 to help in the planning of oil wells 540 or in the drilling of oil wells 540.

In one aspect, the disclosure features a method. The method includes identifying tight spots in movements of a drill string in an oil well by comparing a large interval hookload moving average to a short interval hookload moving average, comparing a large interval bit depth moving average to a short interval bit depth moving average, and DBSCANing the tight spots to identify a fully-stuck event.

In one aspect, the disclosure features a method. The method includes a processor determining that a large interval hookload moving average is greater than a short interval hookload moving average by a hookload threshold and that a large interval bit depth moving average is greater than a short interval bit depth moving average by a bit depth threshold. In response to this determination, the processor retrieves the bit depth and stores it as part of a tight spot record. The processor runs a DBSCAN of the depths in stored tight spot records and finds a cluster at a fully-stuck depth. In response, the processor displays a fully-stuck event on a display.

Embodiments may include one or more of the following. The method may include reading hook load from a rig. The method may include reading bit depth from the rig. The method may include computing the large interval hookload moving average. The method may include computing the small interval hookload moving average. The method may include computing the large interval bit depth moving average. The method may include computing the small interval bit depth moving average. The method may include performing the reading and computing elements periodically. Computing the large interval hookload moving average may include computing an average of the hookload over a time LHKLD prior to the time of the most recent reading of hookload from the rig. Computing the small interval hookload moving average may include computing an average of the hookload over a time SHKLD<LHKLD prior to the time of the most recent reading of hookload from the rig. Computing the large interval bit depth moving average may include computing an average of the bit depth over a time LBLK_POS prior to the time of the most recent reading of bit depth from the rig. Computing the small interval bit depth moving average may include computing an average of the bit depth over a time SBLK_POS<LBLK_POS prior to the time of the most recent reading of bit depth from the rig. SHKLD may be much less than LHKLD. SBLK_POS may be much less than LBLK_POS. The DBSCAN may have the following settings: a direct density-reachable distance of at least 10 feet and a number of points required to form a cluster of at least 30. The processor subsequently may determine that the drill string is free based on bit depth readings made after the fully-stuck event was displayed, and, as a result, clearing the fully-stuck event.

In one aspect, the disclosure features a system. The system includes a drilling rig that includes a supply spool and an anchor. The system includes a drill line coupled to the supply spool and the anchor. The system includes a hook coupled to the drill line. The system includes a drill string suspended in a borehole, wherein the drill string is suspended from the hook. The system includes a bit coupled to the drill string. The system includes a hookload sensor coupled to the drill line for determining a load on the hook. The system includes a bit depth sensor coupled to the supply spool for determining a depth of the bit. The system includes a processor to receive inputs from the hookload sensor and the bit depth sensor and identify fully stuck events in which the drill string is stuck in a borehole.

Implementations may include one or more of the following. The processor may identify fully stuck events by performing a method. The method may include the processor determining a large interval hookload moving average is greater than a short interval hookload moving average by a hookload threshold and a large interval bit depth moving average is greater than a short interval bit depth moving average by a bit depth threshold. In response to that determination, the processor may retrieve the bit depth and store it as part of a tight spot record. The processor may run a DBSCAN of the depths in stored tight spot records and finding a cluster at a fully-stuck depth. In response, the processor may display a fully-stuck event on a display.

References in the specification to "one or more embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Embodiments include features, methods or processes that may be embodied within machine-executable instructions provided by a machine-readable medium. A computer-readable medium includes any mechanism which provides (i.e., stores and/or transmits) information in a form accessible by a machine (e.g., a computer, a network device, a personal digital assistant, manufacturing tool, any device with a set of one or more processors, etc.). In an exemplary embodiment, a computer-readable medium includes non-transitory volatile and/or non-volatile media (e.g., read only memory (ROM), random access memory (RAM), magnetic disk storage media, optical storage media, flash memory devices, etc.), as well as transitory electrical, optical, acoustical or other form of propagated signals (e.g., carrier waves, infrared signals, digital signals, etc.).

Such instructions are utilized to cause a general or special purpose processor, programmed with the instructions, to perform methods or processes of the embodiments. Alternatively, the features or operations of embodiments are performed by specific hardware components which contain hard-wired logic for performing the operations, or by any combination of programmed data processing components and specific hardware components. One or more embodiments include software, data processing hardware, data processing system-implemented methods, and various processing operations, further described herein.

One or more figures show block diagrams of systems and apparatus for a system for monitoring hookload, in accordance with one or more embodiments. One or more figures show flow diagrams illustrating operations for monitoring hookload, in accordance with one or more embodiments. The operations of the flow diagrams are described with references to the systems/apparatus shown in the block diagrams. However, it should be understood that the operations of the flow diagrams could be performed by embodiments of systems and apparatus other than those discussed with reference to the block diagrams, and embodiments discussed with reference to the systems/apparatus could perform operations different than those discussed with reference to the flow diagrams.

The word "coupled" herein means a direct connection or an indirect connection.

The text above describes one or more specific embodiments of a broader invention. The invention also is carried out in a variety of alternate embodiments and thus is not limited to those described here. The foregoing description of an embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A method comprising:

identifying tight spots in movements of a drill string in an oil well by:

determining that, at a plurality of bit depths, a difference between a large interval hookload moving average computed over a large time interval that is different for each of the plurality of bit depths and a short interval hookload moving average computed over a small time interval that is different for each of the plurality of bit depths, the small time interval being shorter than the large time interval and being contained within the large time interval, is greater than a hookload threshold, determining that, at the plurality of bit depths, a difference between a large interval bit depth moving average computed over the large time interval and a short interval bit depth moving average computed over the small time interval is less than a bit depth threshold, and, as a result, storing the bit depth as a tight spot; and finding a cluster of tight spots within a depth range of one of the tight spots to identify a fully-stuck event.

2. A method comprising:

at a plurality of bit depths:

reading hook load from a rig;

reading bit depth from the rig;

computing a large interval hookload moving average;

computing a small interval hookload moving average;

computing a large interval bit depth moving average;

computing a small interval bit depth moving average;

determining:

the difference between the large interval hookload moving average and the short interval hookload moving average is greater than a hookload threshold; and the difference between the large interval bit depth moving average and the & short interval bit depth moving average is less than a bit depth threshold; and, in response:

storing the bit depth as part of a tight spot record;

finding a cluster of tight spot records at a fully-stuck depth associated with one of the tight spot records, and, in response:

displaying a fully-stuck event on a display;

wherein:

computing the large interval hookload moving average comprises computing an average of the hookload over a time $L_{HKLD}$ prior to the time of the most recent reading of hookload from the rig, wherein $L_{HKLD}$ is the time length of the hookload large interval;

computing the small interval hookload moving average comprises computing an average of the hookload over a time $S_{HKLD}<L_{HKLD}$ prior to the time of the most recent reading of hookload from the rig, wherein $S_{HKLD}$ is the time length of the hookload small interval and the hookload small interval is contained within the hookload large interval;

computing the large interval bit depth moving average comprises computing an average of the bit depth over a time $L_{BLK_POS}$ prior to the time of the most recent reading of bit depth from the rig, wherein $L_{BLK_POS}$ is the time length of the bit depth large interval; and computing the small interval bit depth moving average comprises computing an average of the bit depth over a time $S_{BLK_POS}<L_{BLK_POS}$ prior to the time of the most recent reading of bit depth from the rig, wherein $S_{BLK_POS}$ is the time length of the bit depth small interval and the bit depth small interval is contained within the bit depth large interval.

3. The method of claim 2 further comprising:

performing the reading and computing elements periodically.

4. The method of claim 2 wherein:

$$L_{HKLD}>>S_{HKLD}; \text{ and}$$

$$L_{BLK_POS}>>S_{BLK_POS}.$$

5. The method of claim 2 wherein:

the search for the cluster of tight spot records has the following settings:

a direct density-reachable distance of no more than 10 feet; and a number of points required to form a cluster of at least 30.

6. The method of claim 2 further comprising:

subsequently determining that a drill string is free based on bit depth readings made after the fully-stuck event was displayed, and, as a result, clearing the fully-stuck event.

7. A system comprising:

a drilling rig comprising a supply spool and an anchor;

a drill line coupled to the supply spool and the anchor;

a hook coupled to the drill line;

a drill string suspended in a borehole, wherein the drill string is suspended from the hook;

a bit coupled to the drill string;

a hookload sensor coupled to the drill line for determining a load on the hook;

a bit depth sensor coupled to the supply spool for determining a depth of the bit;

a processor to receive inputs from the hookload sensor and the bit depth sensor and identify, using the inputs from the hookload sensor and the bit depth sensor, fully stuck events in which the drill string is stuck in a borehole;

wherein the processor identifies fully stuck events by performing the following method:

the processor determining at a bit depth:

a difference between a large interval hookload moving average and a short interval hookload moving average is greater than a hookload threshold; and a difference between a large interval bit depth moving average and a short interval bit depth moving average by is less than a bit depth threshold; and, in response:

the processor retrieving the bit depth and storing it as part of a tight spot record;

the processor finding a cluster of tight spot records at a fully-stuck depth associated with one of the tight spot records, and, in response:

the processor displaying a fully-stuck event on a display.

8. The system of claim 7, wherein the method further comprises:

reading hook load from a rig;

reading bit depth from the rig;

computing the large interval hookload moving average;

computing the small interval hookload moving average;

computing the large interval bit depth moving average; and computing the small interval bit depth moving average.

9. The system of claim 8, wherein the method further comprises:

performing the reading and computing elements periodically.

10. The system of claim 8 wherein:

computing the large interval hookload moving average comprises computing an average of the hookload over a time $L_{HKLD}$ prior to the time of the most recent reading of hookload from the rig, wherein $L_{HKLD}$ is the time length of the hookload large interval;

computing the small interval hookload moving average comprises computing an average of the hookload over a time $S_{HKLD}<L_{HKLD}$ prior to the time of the most recent reading of hookload from the rig, wherein $S_{HKLD}$ is the time length of the hookload large interval;

computing the large interval bit depth moving average comprises computing an average of the bit depth over a time $L_{BLK_POS}$ prior to the time of the most recent reading of bit depth from the rig, wherein $L_{BLK_POS}$ is the time length of the bit depth large interval; and computing the small interval bit depth moving average comprises computing an average of the bit depth over a time $S_{BLK_POS}<L_{BLK_POS}$ prior to the time of the most recent reading of bit depth from the rig, wherein $S_{BLK_POS}$ is the time length of the bit depth small interval.

11. The system of claim 10 wherein:

$L_{HKLD}>>S_{HKLD}$; and $L_{BLK_POS}>>S_{BLK_POS}$.

12. The system of claim 10 wherein:

the search for the cluster of tight spot records has the following settings:

a direct density-reachable distance of at least 10 feet; and a number of points required to form a cluster of at least 30.

13. The system of claim 10, wherein the system further comprises: the processor subsequently determining that the drill string is free based on bit depth readings made after the fully-stuck event was displayed, and, as a result, clearing the fully-stuck event.

* * * * *